US006139414A

United States Patent [19]

Domanski et al.

[11] Patent Number: 6,139,414

[45] Date of Patent: Oct. 31, 2000

[54] FLEXIBLE TOOL FOR PLATEAUING A SURFACE

[75] Inventors: Stanley K. Domanski, Norridge; Stephen C. Ball, Mt. Prospect, both of Ill.

[73] Assignee: Accu-Out Diamond Tool Company, Inc., Norridge, Ill.

[21] Appl. No.: 09/213,969

[22] Filed: Dec. 17, 1998

Related U.S. Application Data

[63] Continuation-in-part of application No. 08/853,268, May 9, 1997, abandoned.

[51] Int. Cl.[7] ..... B24B 9/02

[52] U.S. Cl. ..... 451/471; 451/482; 451/504; 451/507

[58] Field of Search ..... 451/470, 471, 451/472, 473, 482, 485, 487, 504, 507, 514, 523, 524, 547

[56] References Cited

U.S. PATENT DOCUMENTS

| | | | |
|---|---|---|---|
| 426,862 | 4/1890 | Ross, Jr. | 451/507 |
| 2,326,711 | 8/1943 | Weiland . | |
| 2,472,554 | 6/1949 | Volis . | |
| 2,638,722 | 5/1953 | Rimmel . | |
| 2,702,446 | 2/1955 | Johnson | 451/507 |
| 2,774,200 | 12/1956 | Block . | |
| 3,166,876 | 1/1965 | Manchester . | |
| 3,526,057 | 9/1970 | Hackman, Jr. . | |
| 4,188,755 | 2/1980 | Fitzpatrick . | |
| 4,223,485 | 9/1980 | Largeteau . | |
| 4,275,530 | 6/1981 | Largeteau . | |
| 4,458,453 | 7/1984 | Helms et al. | 451/507 X |
| 5,022,196 | 6/1991 | Schimweg et al. . | |
| 5,185,970 | 2/1993 | Fiocchi . | |
| 5,371,978 | 12/1994 | Higashikawa . | |
| 5,482,498 | 1/1996 | Higashikawa . | |
| 5,529,529 | 6/1996 | Judge et al. . | |
| 5,672,096 | 9/1997 | Amarosa, Sr. et al. . | |
| 5,707,279 | 1/1998 | Mitchell et al. | 451/504 X |

*Primary Examiner*—Timothy V. Eley
*Attorney, Agent, or Firm*—Brooks & Kushman P.C.

[57] ABSTRACT

The present invention provides a radially expandable plateauing tool for finishing bore surfaces. The tool includes a shank for attachment to a means for rotation, and a substantially cylindrical portion including an outer work-engaging surface including abrasive particles secured thereto, and an inner surface defining a bore therethrough with at least one longitudinal split permitting radial expansion and contraction of the cylindrical portion. A metallic spring is disposed within the bore and a threaded bolt assembly or other device is provided for applying an axial compressive force on the spring such that the spring exerts a radial expansive force on the cylindrical portion causing the cylindrical portion to expand to adjust the outer work-engaging surface. The spring is comprised with longitudinal splits aligned with corresponding longitudinal splits on the cylindrical portion to permit coolant flow therethrough.

11 Claims, 6 Drawing Sheets

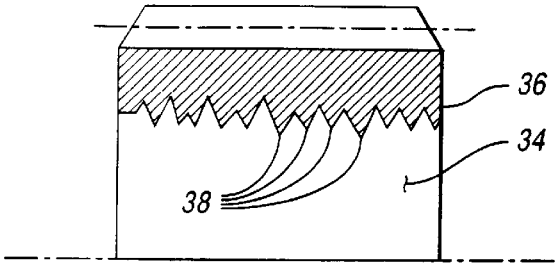
Fig. 3a
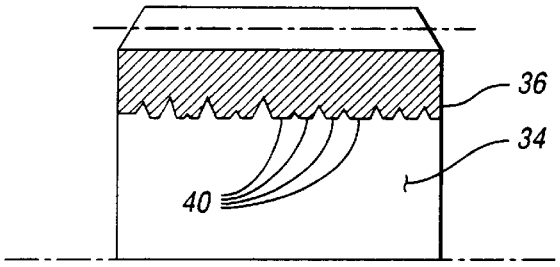
Fig. 3b
Fig. 4
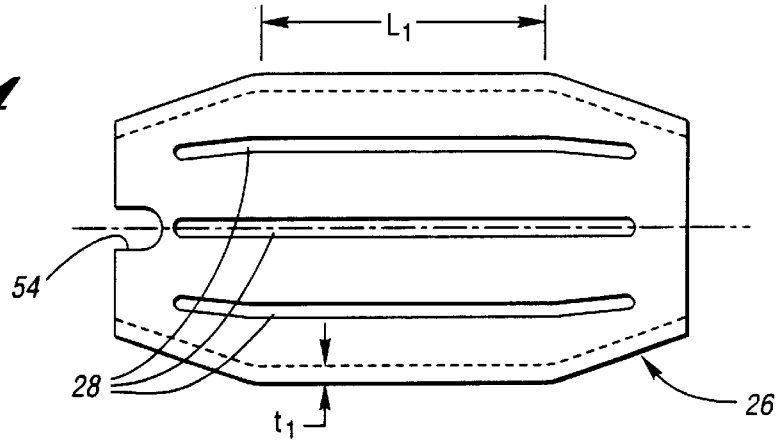
Fig. 5
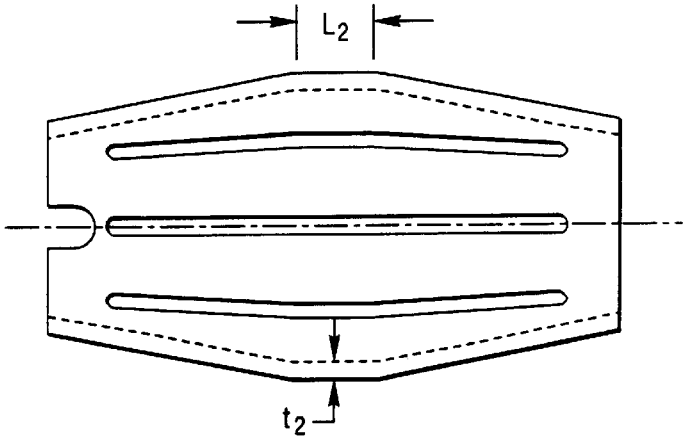

Fig. 6
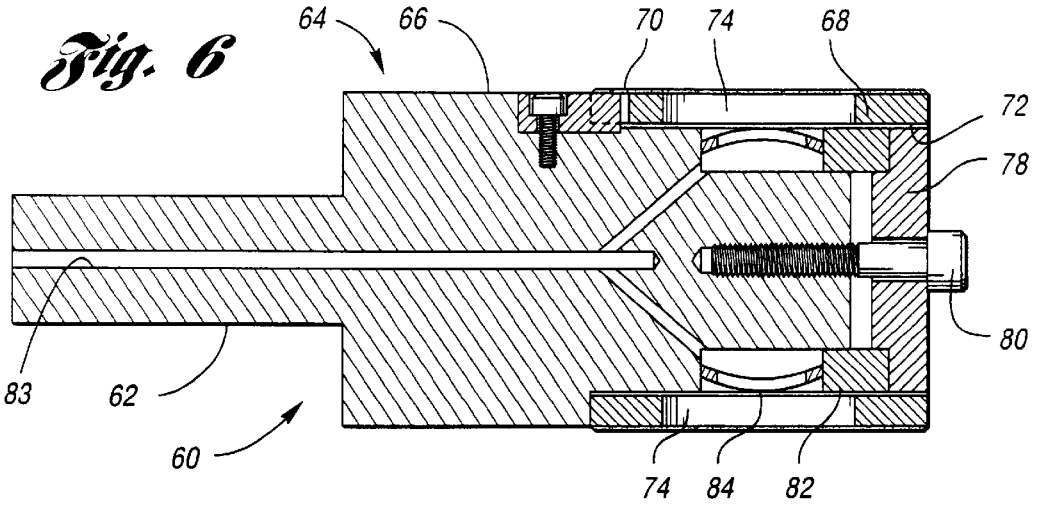
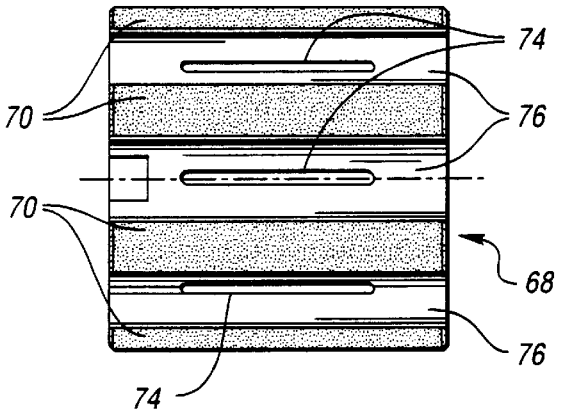
Fig. 7
Fig. 8
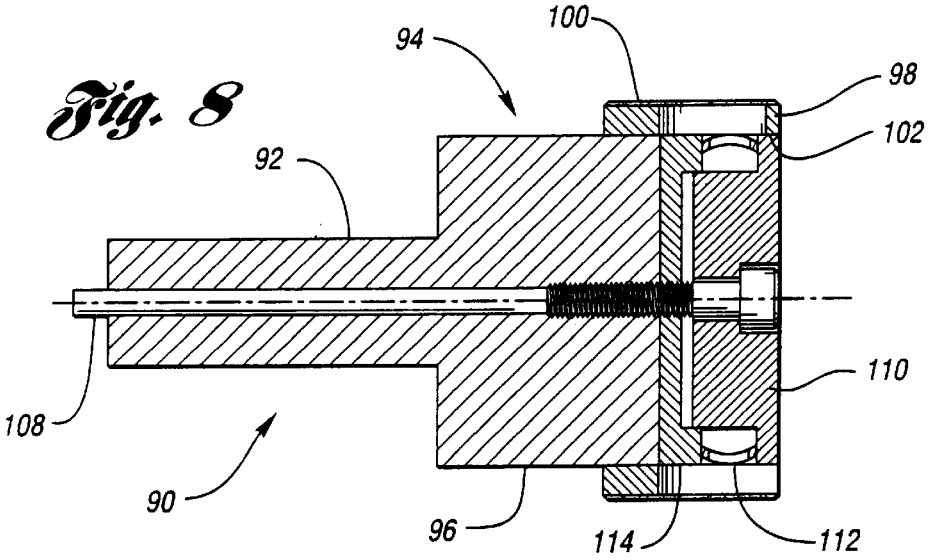

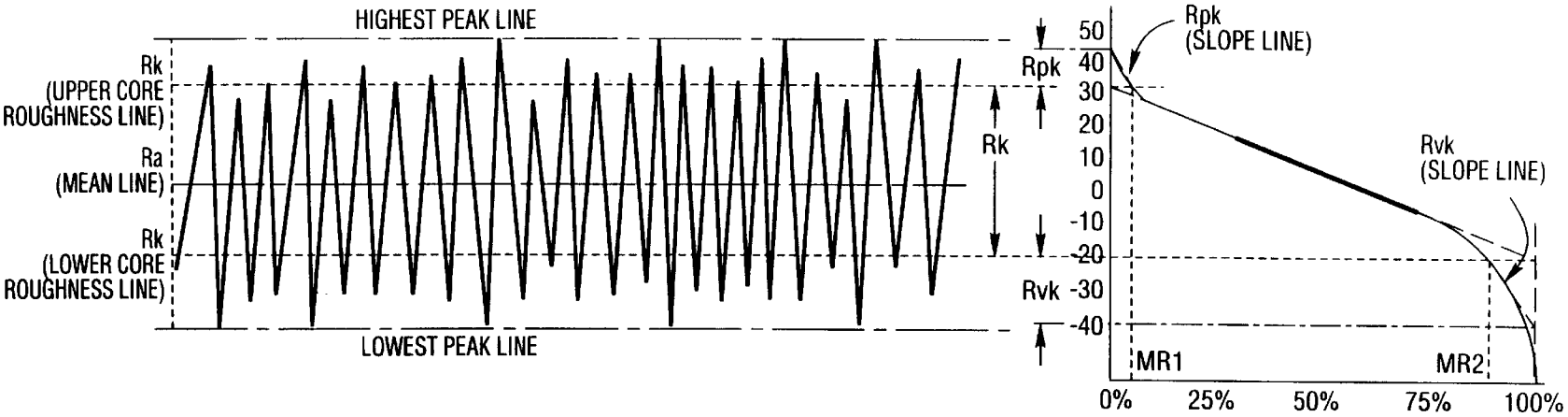
Fig. 13a
Fig. 13b
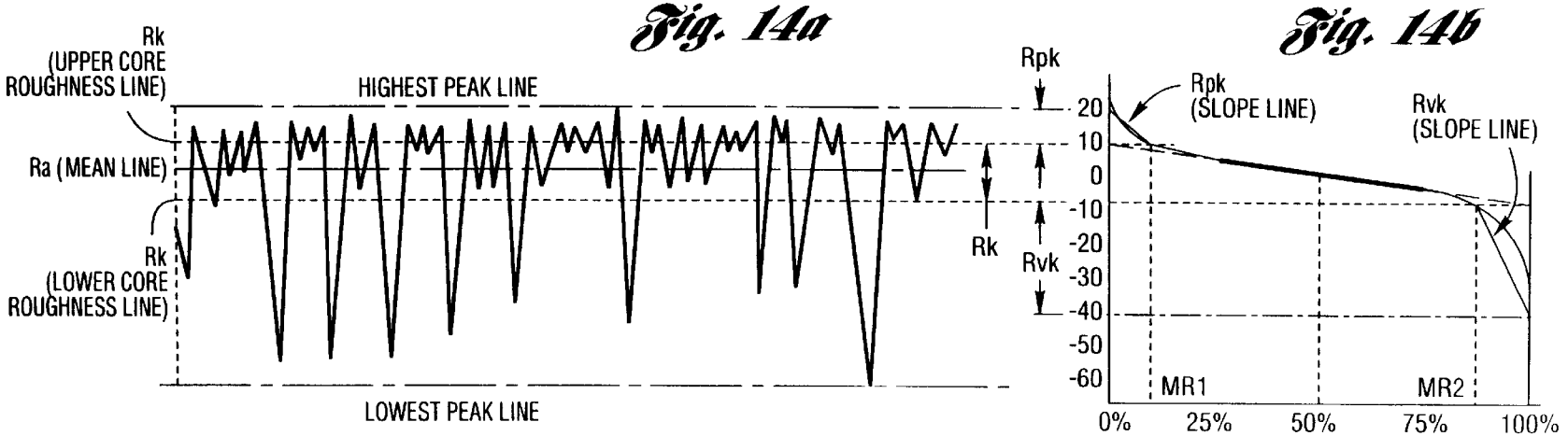
Fig. 14a
Fig. 14b

FLEXIBLE TOOL FOR PLATEAUING A SURFACE

CROSS-REFERENCE TO RELATED APPLICATION

This application is a continuation-in-part of U.S. patent application Ser. No. 08/853,268, now abandoned filed May 9, 1997, entitled "Flexible Superfinishing Tool".

TECHNICAL FIELD

The present invention relates generally to machine tools and more particularly to an adjustable tool for forming a plateaued surface on a bore.

BACKGROUND ART

Precision bores such as for engine cylinders, fuel injectors, bearing bores, and gear bores are typically produced by the steps of: 1) boring or drilling to produce an initial bore; 2) reaming, boring, grinding or honing the bore with conventional tooling to enlarge and finish the hole, thus providing accurate dimensions and improving the finish of the bore walls; and 3) superfinishing the bore to smooth the surface of the bore.

The term "superfinishing" is herein used in reference to lapping, deburring, polishing, or other operations in which substantially improved surface characteristics are achieved. Machine tools for superfinishing are known in the art which have means for adjusting inserted blades or stones such that a definite size can be maintained through numerous cuttings and grindings and used-up blades can be replaced with new ones. U.S. Pat. No. 2,472,554 discloses an expandable reamer comprising a hollow cylinder and a shank axially extending therefrom, the cylinder having a plurality of radially disposed slots in its wall, each retaining a radially disposed blade extending therefrom.

Adjustable reamers are also known which are expandable such as by means of a wedge or tapered cone internal to the cylindrical cutting tool. U.S. Pat. No. 3,526,057 describes an axially tapered lap holding part which is capable of radially expanding or contracting. The lap holding part includes means for axially retaining a lap which is capable of radially expanding or contracting with the lap holding part, means for moving an axially tapered arbor with respect to the axial taper on the lap holding part to radially expand or contract the lap holding part, and means for maintaining the lap holding part axially stationary during its radial expansion or contraction so that the lap radially expands or contracts with the lap holding part without changing the relative axial position of the lap with respect to the workpiece that the lap is abrading.

U.S. Pat. No. 5,022,196 discloses a radially adjustable honing tool mountable for rotation on a honing machine comprising an elongated tubular cutting member having a slit extending lengthwise along its entire length and inner and outer surfaces wherein the inner surface is conically tapered over substantially the length thereof. The tool further comprises an elongated expander member positioned extending through the tubular member, having an outer surface tapered for making surface-to-surface contact with the tapered inner surface of the tubular member wherein the expander member is axially movable within the tubular member to change the diameter thereof uniformly along its length such that axial movement of the extender changes the diameter of the tubular cutting member.

Adjustable reamers and cutting tools such as those described above are complex and expensive and may provide more precision with respect to bore diameters than is necessary for a finishing step. Accordingly, there remains a need in the art for simple, inexpensive machine tools for superfinishing of bores.

Another problem with available prior art superfinishing equipment is that it provides surface bearing ratios generally in the range of 0.5% to 10%. No inexpensive superfinishing equipment is known which consistently provides surface bearing ratios greater than 10%.

DISCLOSURE OF INVENTION

The present invention overcomes the above-referenced shortcomings of prior art superfinishing tools by providing a radially flexible tool for finishing bore surfaces including a barrel-shaped metal spring disposed within a cylindrical portion of the tool for selectively expanding the cylindrical portion by axially compressing the metal spring, thereby enabling "plateauing" of the bore surface and enabling improved bore surface bearing ratios.

More specifically, the present invention provides a tool for finishing bore surfaces including a shank portion and a substantially cylindrical portion extending from the shank portion. The cylindrical portion includes an outer work-engaging surface adapted for finishing a workpiece with abrasive particles. The cylindrical portion also includes an inner surface defining a bore therethrough and at least one longitudinal split permitting radial expansion and contraction of at least part of the cylindrical portion. A substantially barrel-shaped metal spring is disposed within the bore. The metal spring includes at least one longitudinal split permitting radial expansion against the inner surface. An apparatus is provided for applying an axial compressive force on the metal spring such that the spring exerts a radial expansive force against the inner surface to cause the substantially cylindrical portion to expand radially.

Preferably, the metal spring and cylindrical portion are comprised of materials having substantially the same coefficient of expansion to eliminate tool distortion under high heat conditions. Also, preferably, each longitudinal split of the cylindrical portion is aligned with a corresponding longitudinal split of the metal spring to allow coolant flow therethrough.

The invention contemplates various structures for applying an axial compressive force on the metal spring. The details of the particular structure employed for applying the axial compressive force are a non-critical component of the invention. One such apparatus comprises a threaded bolt assembly at the machine end of the tool which may be readily adjusted by means of a wrench or other tool to compress or release the metal spring. Another embodiment contemplated is a draw bar disposed axially within the bore and proceeding axially within the shank to the machine side of the superfinishing tool in order that tension applied by movement of the draw bar in the machine direction would apply an axial compressive force on the metal spring disposed concentrically around the draw bar. This structure could be used for in-process adjustment of the radius of the superfinishing tool.

The invention further contemplates the use of a non-compressible spacer located within the bore of the cylindrical portion. The spacer can be positioned adjacent the apparatus for applying an axial compressive force, but is preferably located at the opposite end of the bore from the threaded bolt assembly.

The superfinishing tool preferably comprises one or more flutes on the cylindrical member which are useful for circulation of cooling and lubricating fluids and which further provide for removal of debris and material chips created from the workpiece during the finishing process.

The cylindrical portion comprises an outer work-engaging surface including a portion or portions coated with abrasive particles. Preferred abrasive particles include diamonds of various sizes, but other abrasive particles including carbide and the like may be used according to the general skill in the art.

As one surprising aspect of the invention, it has been found that superfinishing tools of the invention are capable of producing finished bore surfaces characterized by bearing ratios of from about 40% to about 80%.

Accordingly, an object of the present invention is to provide a superfinishing tool adjustable by means of a barrel-shaped metallic spring having longitudinal slots formed therein for expanding a cylindrical portion of the tool.

The above object and other objects, features, and advantages of the present invention are readily apparent from the following detailed description of the best mode for carrying out the invention when taken in connection with the accompanying drawings.

BRIEF DESCRIPTION OF DRAWINGS

FIG. 3*a* is a schematic partial cross-sectional view of a pinion gear prior to "plateauing" in accordance with the present invention;

FIG. 3*b* is a schematically-arranged partial cross-sectional view of the pinion gear of FIG. 3*a* after "plateauing" in accordance with the invention;

FIG. 4 shows a side view of a metal spring in accordance with the present invention;

FIG. 5 shows a side view of a metal spring in accordance with an alternative embodiment of the invention;

FIG. 6 is a longitudinal cross-sectional view of a tool in accordance with a second alternative embodiment of the invention;

FIG. 7 shows a side view of a sleeve for use with the embodiment shown in FIG. 6;

FIG. 8 shows a longitudinal sectional view of a tool in accordance with a third alternative embodiment of the invention;

FIG. 13*a* shows a graphical illustration of surface roughness for an unfinished surface showing an equal distribution of peak height and valley depth;

FIG. 13*b* shows a graphical illustration of a material ratio curve corresponding with FIG. 13*a;*

FIG. 14*a* shows a graphical illustration of a plateaued surface having an unequal distribution of peak height and valley depth;

FIG. 14*b* shows a graphical illustration of a material ratio curve corresponding with FIG. 14*a;*

BEST MODES FOR CARRYING OUT THE INVENTION

Figure 1:
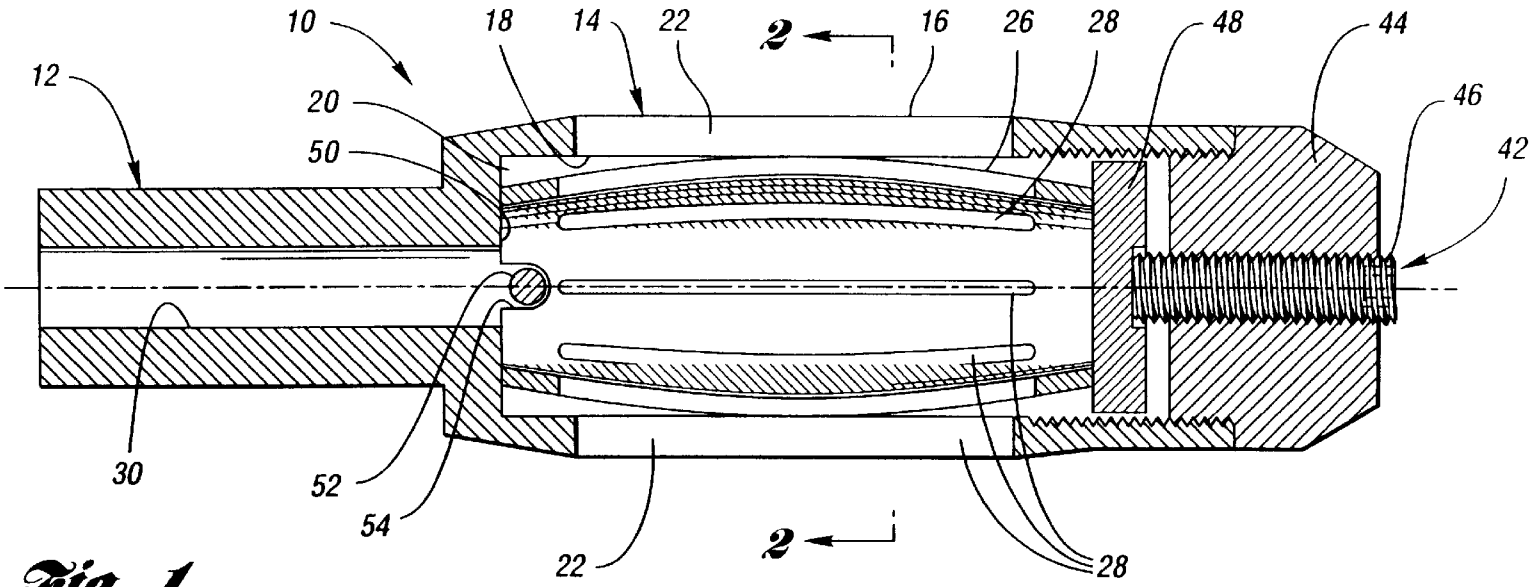
FIG. 1 is a longitudinal cross-sectional view of a tool in accordance with the present invention.
Figure 2:
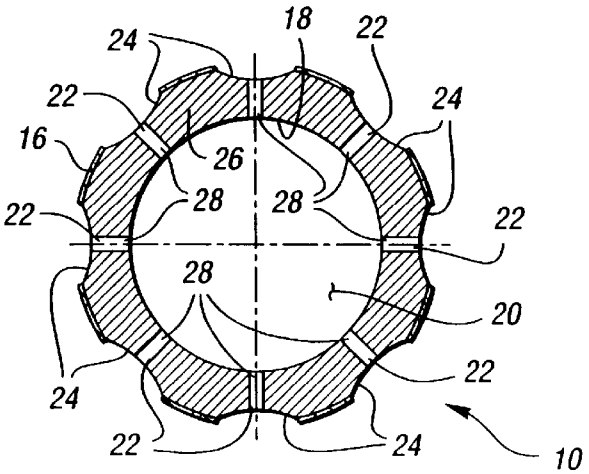
FIG. 2 is a cross-sectional view taken at line 2—2 of FIG. 1.

The primary function of the plateauing tool of the invention is to remove the "peaks" of a surface finish within a semi-finished bore. FIGS. 1 and 2 depict a plateauing tool 10 capable of this function.

The tool 10 comprises a shank portion 12 for attachment to a means of rotation, such as by mounting on a milling machine, drill press, or other similar machine tool. The plateauing tool 10 further comprises a substantially cylindrical portion 14 including an outer work-engaging surface 16 having at least a portion with abrasive particles such as diamonds attached thereto, and an inner surface 18 defining a bore 20 through the substantially cylindrical portion 14.

The substantially cylindrical portion 14 defines at least one longitudinal split 22 permitting radial expansion and contraction of the cylindrical portion 14. The cylindrical portion 14 is also defined by one or more flutes 24, shown in FIG. 2, which are useful for circulation of cooling and lubricating fluids and which further provide for removal of debris and dust created from the workpiece during the finishing process.

The plateauing tool 10 further comprises a substantially barrel-shaped metal spring 26 disposed within the bore 20 of the cylindrical portion 14. The metal spring 26 has a plurality of longitudinal splits 28 permitting radial expansion against the inner surface 18 of the cylindrical portion 14, as shown in FIGS. 1, 2 and 4. As shown, the splits 22 of the cylindrical portion 14 are substantially aligned with the splits 28 of the metal spring 26 to allow coolant flow therethrough, therefore, coolant entering the passage 30 of the shank portion 12 enters the bore 20 of the cylindrical portion 14 through the center of the metal spring 26, and passes through the aligned splits 28,22 in the spring 26 and cylindrical portion 14, respectively, to cool the abrasive surface 16 and workpiece.

Accordingly, coolant fed through the passage 30 fills the spring 26 and is forced to exit the spring through the expansion splits 28,22. The adjusting screw 46 keeps the coolant from passing out of the front cap 44 of the tool 10. The coolant can be oil or water soluble coolant, depending on the application. By flushing the coolant through the tool, the point of contact between the abrasive and the bore is kept cool to eliminate any variability caused by heat. The flushing also removes the surface particles generated by the plateauing process, thereby providing a clean and predictable plateauing value.

Referring to FIGS. 3*a* and 3*b*, the surface texture of a pinion gear bore is shown before and after "plateauing" by the above-described tool 10, respectively. As shown, the bore 34 of the pinion gear 36 has a series of peaks 38 which are removed by the above-described tool to form the plateaus 40. This is achieved primarily by providing proper axial compression on the metal spring 26 so that the metal spring expands radially outwardly against the inner surface 18 of the cylindrical portion 14 to expand the outer work-engaging surface 16 against the work surface being finished in a manner such that the outer work-engaging surface 16 is somewhat flexible to provide the plateauing effect. The bore 34 will likely have a bearing ratio of at least 60% as a result of being finished by a plateauing tool in accordance with the invention.

As shown in FIG. 1, the tool 10 is provided with an apparatus 42 for applying an axial compressive force on the spring 26. The axial compressive force may be applied in any of a variety of manners. In one embodiment, shown in FIG. 1, a front cap 44 is threaded onto the substantially cylindrical portion 14, and a tensioning screw 46 is threaded within the front cap 44, and includes a disk 48 at an end thereof for axially compressing the metal spring 26 against the end portion 50 of the shank 12. Accordingly, rotation of the tensioning screw 46 will axially compress the metal spring 26 to radially expand the metal spring 26 against the inner surface 18 of the cylindrical portion 14, thereby expanding the cylindrical portion 14 for adjustment of the outer work-engaging surface 16. Such expansion helps the plateauing tool to better conform to the bore to be finished and allows the tool to be used to finish bores of slightly different sizes. The expansive forces are reacted against by the forces from the bore surface as the machining occurs regardless of bore geometry, and these forces will balance each other to properly position the work-engaging surface 16 of the plateauing tool 10 for optimizing the bearing ratio of the bore surface. In this manner, the selectively compressed metal spring 26 causes the tool 10 to self-adjust as a result of forced balancing, which improves the bearing ratio substantially because the force balance may be adjusted so that the abrasive surface removes the peaks from the bore surface, thus creating an optimal ratio of flat portions to valley size.

The ability of the plateauing tool to better conform to bores to be finished provides improvements in the quality and properties of the bores so finished. Such improved qualities also include improvements in oil retention levels and higher load carrying capabilities.

As further shown in FIG. 1, the cylindrical portion 14 is provided with a radial position keeper 52, which engages the slot 54 in the metal spring 26 to prevent rotation of the metal spring 26 as the tensioning screw 46 is rotated.

The metal spring 26 is preferably a tool steel material which has more "memory" than standard cold-rolled steel. The spring is made by conventional processes, such as lathe cutting, to generate the inside and outside diameter and form. The longitudinal splits 28 are generated by a milling operation.

The plateau tooling is designed to be used in high production manufacturing. Prior art tools are generally used manually, rather than automatically, with loose abrasive paste for polishing a bore for achieving a polished or surface finish. In high volume manufacturing, the plateauing tools with bonded abrasive are expected to work cycle after cycle. This repetitious cycling generates heat. In order to achieve stability in a manufacturing process for size and surface texture, the tooling must be able to remain stable under heat. By having the plateauing tool constructed from steel, and manufacturing the metal spring 26 also of steel, the difference between the coefficient of expansion of the two materials is negligible so distortion of the tooling under high heat conditions is eliminated. Additionally, the feeding of coolant through the tool, as described above, reduces heat build-up, which further reduces the distortion problem.

The form and shape of the metallic spring 26 can be designed to specifically position the location and width of the expansion area of the plateauing tool abrasive surface 16 against the bore. Depending on the bore length of the application and the presence or absence of any interruptions in the bore, the width of the expanded tool surface is important to the success of the process. Bores with interruptions (cross holes or cavities) require a longer expansion area on the plateauing tool to bridge the gaps.

Referring to FIGS. 4 and 5, the contact surface lengths $L_1$, $L_2$ may be sized accordingly. Additionally, the wall thickness $t_1$, $t_2$ of the spring 26 affects the amount of expansion of the spring 26 and resulting surface pressure generated between the plateauing tool and the workpiece. Increasing the wall thickness $t_1$, $t_2$ of the spring 26 increases the surface pressure (for hard material applications), and decreasing the wall thickness $t_1$, $t_2$ reduces the surface pressure (for softer material applications). The wide area of expansion $L_1$ shown in FIG. 4 is generally used for long bore length or interrupted bore applications. The narrow expansion area $L_2$ of the plateauing tool shown in FIG. 5 is used for short bore length applications.

Hardened materials require a higher degree of surface pressure than softer materials during the plateauing process. The degree of surface pressure will determine the degree of plateauing achieved, which affects bearing ratio values.

FIG. 6 shows a longitudinal cross-sectional view of a plateauing tool 60 in accordance with an alternative embodiment of the invention. This tool 60 comprises a shank or arbor 62 with a substantially cylindrical portion 64 extending therefrom. The substantially cylindrical portion 64 includes a body 66 with a cylindrical sleeve 68 secured therearound. The sleeve 68 includes an outer work-engaging surface 70 for finishing a workpiece with abrasive particles. The cylindrical sleeve 68 further includes an inner surface 72 defining a bore.

As shown in FIG. 7, the cylindrical sleeve 68 includes a plurality of slots 74 formed therein within the flutes 76 to permit radial expansion of the sleeve 68.

Returning to FIG. 6, the substantially cylindrical portion 64 further includes a compression plate 78 which cooperates with a compression screw 80 for advancing a spacer 82 toward or away from the metal spring 84 disposed within the bore formed by the inner surface 72 of the sleeve 68. Accordingly, as the compression screw 80 is rotated, the compression plate 78 advances the spacer 82 toward the spring 84, thereby causing axial compression and radial expansion of the spring 84, which causes the cylindrical sleeve 68 to expand radially due to the relief provided by the plurality of slots 74.

The splits or slots 74 are arranged longitudinal along the sleeve 68 to permit this radial expansion. Of course, the slots 74 could be parallel with the cylindrical axis of the sleeve 68, or could be arranged helically along the sleeve 68.

As shown in FIG. 6, a coolant flow passage 83 is provided to feed coolant through the slots in the metal spring 84, and further through the slots 74 in the sleeve 68 to cool the work area.

The embodiment described with reference to FIGS. 6 and 7 is provided for plateauing a throughbore, and comprises the separate sleeve 68 for large bore applications.

Figure 9:
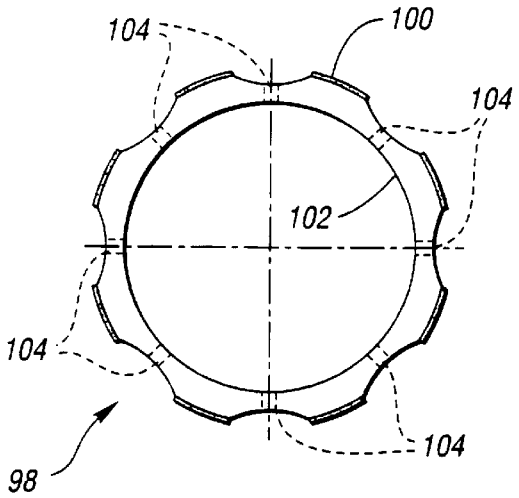
FIG. 9 shows an end view of a sleeve for use with the embodiment shown in FIG. 8.
Figure 10:
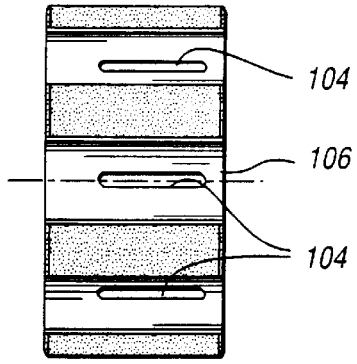
FIG. 10 shows a side view of the sleeve shown in FIG. 9.

Turning to FIGS. 8–10, a second alternative embodiment of the invention is shown for use in semi-blind bores which are not throughbores, but have a relief beyond the surface to be finished. The superfinishing tool 90 illustrated in FIG. 8 includes a shank 92 having a substantially cylindrical portion 94 extending therefrom. The substantially cylindrical portion 94 includes a body 96 with a cylindrical sleeve 98 disposed therearound. The cylindrical sleeve 98 includes an outer work-engaging surface 100 adapted for finishing a workpiece with abrasive particles, and an inner surface 102 defining a bore.

As shown more clearly in FIGS. 9 and 10, the cylindrical sleeve 98 includes a plurality of splits 104 formed therethrough for permitting radial expansion of the sleeve 98.

This embodiment includes contained slots 104, as shown in FIG. 10, which do not extend to the end 106 of the sleeve 98 because this embodiment is adapted for use in a semi-blind bore which includes a relief area past the surface to be finished.

Returning to FIG. 8, this embodiment further comprises a draw bar or screw 108 extending through an aperture formed in the shank 92 and body 96. The draw bar 108 is engageable with the pressure plate 110 for compressing the spring 112 against the support member 114, thereby causing radial expansion of the spring 112, which radially expands the cylindrical sleeve 98.

Figure 11:
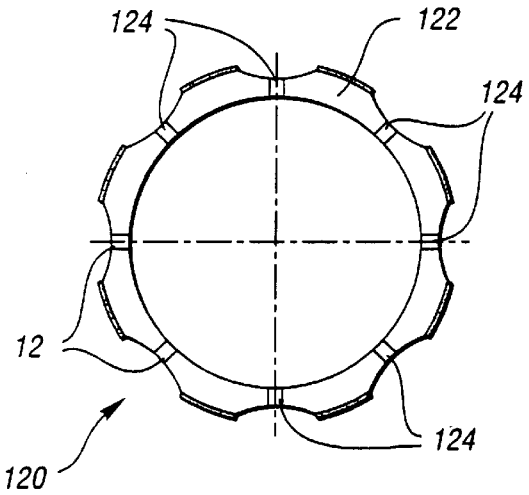
FIG. 11 shows an end view of a sleeve for use in accordance with a fourth alternative embodiment of the invention.
Figure 12:
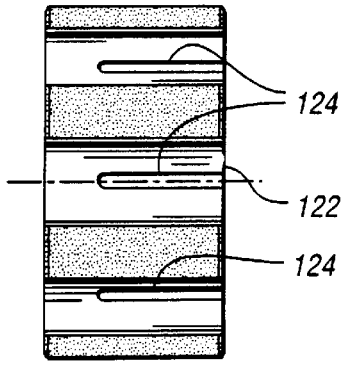
FIG. 12 shows a side view of the sleeve shown in FIG. 11.

Turning to FIGS. 11 and 12, a sleeve 120 is shown for use in accordance with a third alternative embodiment of the invention. This embodiment is configured for use in a blind bore which has little or no relief beyond the surface to be finished. In order to allow maximum expansion at the end 122 of the sleeve, the slots 124 extend all the way to the end 122 of the sleeve 120, as illustrated in FIG. 12, and further illustrated in the end view shown in FIG. 11.

Accordingly, in this configuration, the plateauing tool may be used in blind bore configurations, and the distal end 122 of the sleeve 120 is fully expandable for achieving optimized surface finish characteristics, even closely adjacent the end of the bore.

Figure 15:
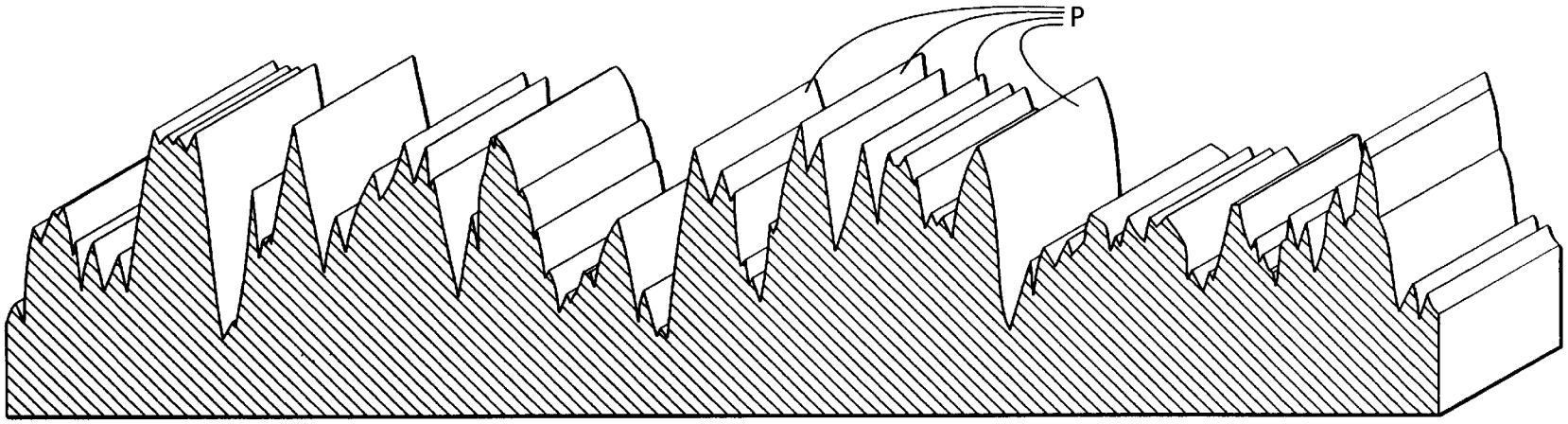
FIG. 15 shows a schematic perspective view of a common surface corresponding with FIGS. 13*a* and 13*b*.

FIGS. 13–16 provide schematic illustrations of surfaces before and after the plateauing operation described herein. The plateau tool described herein may be applied to a common surface, as shown in FIGS. 13*a*, 13*b*, and 15 which has been previously machined by a standard single pass tool, or other reaming or boring process, where the peaks and valleys (Rvk, Rpk) are equal. The plateauing tool removes only a prescribed amount of peaks to generate a predictable Rpk value without changing the size or geometry of the bore (i.e. the roughness average Ra remains the same). With the peaks removed and the valleys still intact to contain oil, this is the ideal condition for applications such as a bearing support surface.

As shown in FIGS. 13*a* and 13*b*, as well as FIG. 15, a common surface will have a roughness with an equal distribution of peak height and valley depth.

Figure 16:
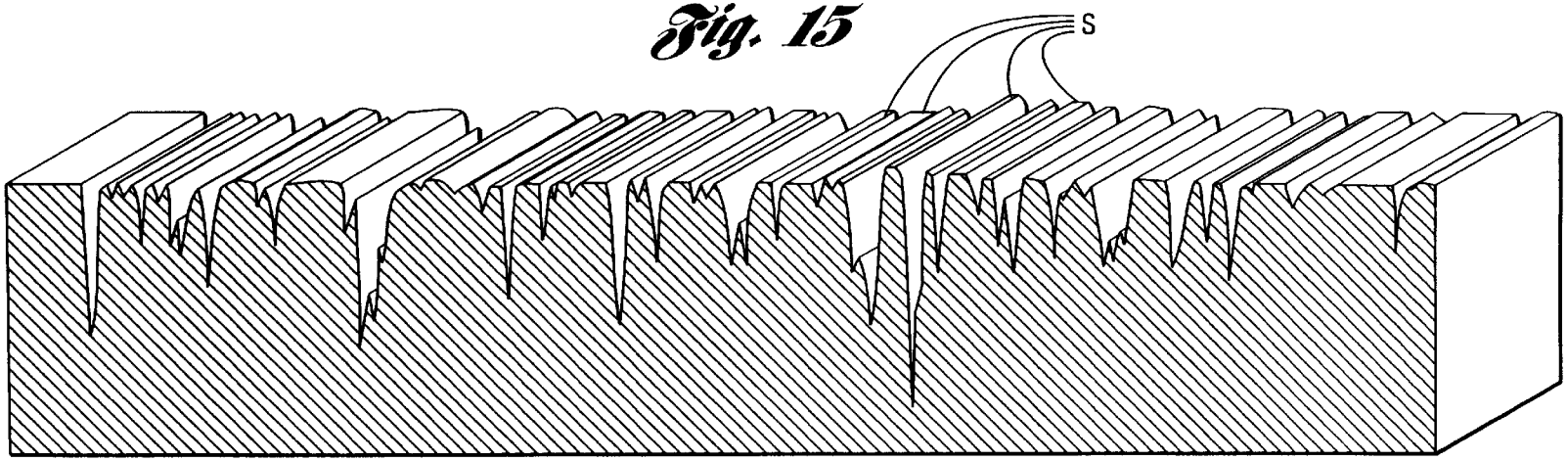
FIG. 16 shows a schematic perspective view of a plateaued surface corresponding with FIGS. 14*a* and 14*b*.

As shown in FIGS. 14*a*, 14*b*, and 16, the surface has been plateaued, thereby removing the peaks, and providing a much flatter material ratio curve and generating a Rpk which is 3–10 times smaller than Rvk, thereby producing bearing ratios in excess of 40%. Comparing FIGS. 15 and 16, the peaks P of FIG. 15 have been removed to form the plateaued surface S of FIG. 16, while the roughness average (Ra) remains at 2.4 micrometers, Rpk is reduced from 2.6 to 0.9 micrometers, Rk is reduced from 8.2 to 1.9 micrometers, and Rvk is increased from 2.6 to 9.8 micrometers by the plateauing process.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A tool for finishing bore surfaces comprising:

a shank portion;

a substantially cylindrical portion extending from said shank portion and including an outer work-engaging surface adapted for finishing a workpiece with abrasive particles, and said substantially cylindrical portion further comprising an inner surface defining a bore therethrough and at least one longitudinal split permitting radial expansion and contraction of at least part of the cylindrical portion;

a substantially barrel-shaped metal spring disposed within the bore, said metal spring having at least one longitudinal split permitting radial expansion against said inner surface; and an apparatus for applying an axial compressive force on said metal spring such that the spring exerts a radial expansive force against said inner surface to cause the substantially cylindrical portion to expand radially.

2. The tool of claim 1, wherein each of said at least one longitudinal split of the cylindrical portion is aligned with a corresponding one of said at least one longitudinal split of the metal spring to allow coolant flow therethrough.

3. The tool of claim 1, wherein said substantially cylindrical portion and said metal spring comprise materials having substantially the same coefficient of expansion to eliminate tool distortion under high heat conditions.

4. The tool of claim 1, wherein said substantially cylindrical portion comprises a body with a cylindrical sleeve secured therearound, said sleeve including said outer work-engaging surface, wherein said sleeve forms said at least one longitudinal split, and wherein compression of said metal spring against the inner surface causes expansion of the sleeve with respect to the body.

5. The tool of claim 4, wherein said at least one longitudinal split of the cylindrical portion is formed through the sleeve and bounded on all sides by the sleeve.

6. The tool of claim 4, wherein said at least one longitudinal split of the cylindrical portion extends to a distal end of the sleeve to permit radial expansion of the sleeve at the distal end for finishing a blind bore.

7. The tool of claim 1, further comprising a draw bar extending through the shank portion and cylindrical portion, and secured to a pressure plate for selectively compressing the metal spring.

8. The tool of claim 1, comprising at least one flute formed on said outer work-engaging surface.

9. The tool of claim 1, wherein said apparatus for applying an axial compressive force comprises at least one threaded bolt assembly disposed at one end of the cylindrical portion.

10. The product manufactured by the tool of claim 1.

11. The product of claim 10, said product comprising a body having at least one bore formed therethrough by the tool, said bore having a surface with a bearing ratio of at least 40% as a result of being machined by said tool.

* * * * *

UNITED STATES PATENT AND TRADEMARK OFFICE

CERTIFICATE OF CORRECTION

PATENT NO : 6,139,414

DATED : October 31, 2000

INVENTOR(S) : Stanley K. Domanski et al.

It is certified that error appears in the above-identified patent and that said Letters Patent are hereby corrected as shown below:

On the cover page correct the name of the Assignee to read as follows:

Accu-Cut Diamond Tool Company, Inc.

Signed and Sealed this

First Day of May, 2001

*Attest:*

Nicholas P. Godici

NICHOLAS P. GODICI

*Attesting Officer*

*Acting Director of the United States Patent and Trademark Office*